US008496364B2

(12) United States Patent
Davis

(10) Patent No.: US 8,496,364 B2
(45) Date of Patent: Jul. 30, 2013

(54) SECURE LIGHTING FIXTURE FOR LIGHT SOURCE AND METHOD OF MANUFACTURE THEREOF

(75) Inventor: Rodney Dwayne Davis, Saltillo, MS (US)

(73) Assignee: Koninklijke Philips N.V., Eindhoven (NL)

( * ) Notice: Subject to any disclaimer, the term of this patent is extended or adjusted under 35 U.S.C. 154(b) by 217 days.

(21) Appl. No.: 13/049,946

(22) Filed: Mar. 17, 2011

(65) Prior Publication Data

US 2012/0236578 A1 Sep. 20, 2012

(51) Int. Cl.
*F21V 17/10* (2006.01)
*F21V 21/30* (2006.01)
*B65D 43/16* (2006.01)

(52) U.S. Cl.
USPC ..... 362/375; 362/374; 220/845; 220/848

(58) Field of Classification Search
USPC ..... 362/374, 375; 220/841, 843, 844, 220/845, 848
See application file for complete search history.

(56) References Cited

U.S. PATENT DOCUMENTS

| | | | | | |
|---|---|---|---|---|---|
| 2,804,229 | A | * | 8/1957 | Bergh et al. | 220/845 |
| 3,055,535 | A | * | 9/1962 | Schneider | 220/326 |
| 3,117,732 | A | * | 1/1964 | Green | 362/322 |
| 3,142,447 | A | | 7/1964 | Bodian | |
| 3,233,820 | A | * | 2/1966 | Williams | 220/845 |
| 3,983,387 | A | | 9/1976 | Steenhoven | |
| 4,317,163 | A | * | 2/1982 | Bout | 362/362 |
| 4,689,729 | A | * | 8/1987 | Ruud et al. | 362/375 |

OTHER PUBLICATIONS

AEL Architectural Egress Luminaire Fluorescent Brochure, Luminaire Lighting Corporation 2008.

* cited by examiner

*Primary Examiner* — Alan Cariaso

(57) ABSTRACT

A housing for a light source, the housing including a base having a plurality of sidewalls which define an opening of a cavity for containing the light source; a flange having a z-shaped cross section attached within the cavity to a sidewall of the sidewalls; a hinge having first and second portions which are rotatably coupled to each other, the first portion attached to the flange; and a cover having a frame and a lens attached to the frame, the frame having an opening and being attached to the second portion of the hinge such that the cover and the base rotate relative to each other about a fixed axis of rotation.

16 Claims, 10 Drawing Sheets

SECURE LIGHTING FIXTURE FOR LIGHT SOURCE AND METHOD OF MANUFACTURE THEREOF

The present system relates to a secure luminaire housing and more particularly, to a tamperproof luminaire housing having a lockable door with a recessed hinge that is suitable for institutional use.

Typically, institutional luminaires (hereafter lighting fixtures or fixtures) such as those used in public locations, outdoor locations, and/or in secure institutions (e.g., prisons and the like) have a base and a door which is a rotationally secured to the base by a hinge which is fully or partially exposed when the door is in a closed position. The door can be locked to secure an interior cavity of the lighting fixture and can be secured in a closed position by a locking mechanism. Unfortunately, conventional exposed hinges are susceptible to tampering attempts to gain access to portions of the fixtures. For example, hinges may be peeled and/or hinge pins may be removed to gain access to the interior cavity of the lighting fixture to remove or damage parts therein. This can be especially problematic in certain environments such as in prisons where parts of the lighting fixture that can be pried loose or removed such as hinge pins, may be used to form weapons such as "shanks" or the like and may be undesirable. Further, vandals typically access interior portions of lighting fixtures to damage illumination sources so as to darken a lighted area and/or to remove components therein for scrap.

In accordance with an aspect of the present system, there is disclosed a housing for a light source, the housing including: a base having a plurality of sidewalls which define an opening of a cavity for containing the light source; a flange having a z-shaped cross section and attached within the cavity to a sidewall of the sidewalls of the base portion; a hinge having first and second portions which are rotatably coupled to each other, the first portion attached to the flange; and/or a cover portion having a frame and a lens portion attached to the frame, the frame having an opening and being attached to the second portion of the hinge such that the cover and base portions rotate relative to each other about a fixed axis of rotation.

The base may include a bottom part from which the sidewalls extend, the bottom part may further include a mounting portion and defining a portion of the cavity. The mounting portion may be utilized for securing a lighting assembly and may include studs or openings for receiving, for example a screw, a rivet, a flange, etc. Adjacent edges of the side portions may be welded to each other. Further, the first and second portions of the hinge may be rotatably secured (e.g., articulated) to each other with a pin located within the cavity and which extends between opposing sidewalls of the plurality of sidewalls of the base portion. These opposing sidewalls may be sides which are other than the side to which the flange is attached. The hinge may include a piano-type hinge with a plurality of knuckles through which the pin extends. Further, the first portion of the hinge may include a fold which extends along a longitudinal length of the hinge in, for example, a direction which is along an axis of the hinge pin. Further, the flange may include a plurality of studs which extend towards a sidewall of the plurality of sidewalls of the base portion which is opposite the sidewall to which the flange is attached. Moreover, the first portion of the hinge may include a plurality of openings each configured to receive a corresponding stud of the plurality of studs.

In accordance with another aspect of the present system, there is disclosed a method for forming a housing for a light source, the method may include acts of: forming a base having a plurality of sidewalls which define an opening of a cavity for containing the light source; attaching a flange having a z-shaped cross section to a sidewall of the sidewalls of the base portion such that the flange is located within the cavity; attaching a first portion of a hinge having first and second portions which are rotatably coupled to each other to first flange; attaching a cover having a frame with an opening to the second portion of the hinge such that the cover and base portions rotate relative to each other about a fixed axis of rotation; and/or attaching a lens to the cover such that light from the light source located within the cavity may pass through the lens.

The method may further include an act of forming a bottom part such that the sidewalls extend from the bottom part and forming a mounting portion for securing a lighting assembly. The mounting portion may include studs or openings for receiving, for example a screw, a rivet, a flange, etc. Further, the method may include an act of rotatably securing the first and second portions of the hinge to each other with a hinge pin which is located within the cavity and which extends between opposing sidewalls of the plurality of sidewalls of the base portion. Further, the method may include an act of folding the first portion of the hinge along a longitudinal length of the hinge. The fold may be in a direction which is away from the frame and may include, for example, a fold which is about 90 degrees.

The method may further include an act of forming a plurality of openings in the first portion of the hinge. Moreover, the method may include an act of securing a plurality of studs to the flange such that the plurality of studs extend towards a sidewall of the plurality of sidewalls of the base portion which is opposite the sidewall to which the flange is attached and the act of the act of attaching a first portion of the hinge to flange may further include an acts of aligning the studs with the openings of the plurality of openings of the first portion of the hinge; and/or passing the plurality of studs through corresponding openings of the plurality of openings of the first portion of the hinge.

The present system is explained in further detail, and by way of example, with reference to the accompanying drawings wherein.

The following are descriptions of illustrative embodiments that when taken in conjunction with the following drawings will demonstrate the above noted features and advantages, as well as further ones. In the following description, for purposes of explanation rather than limitation, illustrative details are set forth such as architecture, interfaces, techniques, element attributes, etc. However, it will be apparent to those of ordinary skill in the art that other embodiments that depart from these details would still be understood to be within the scope of the appended claims. Moreover, for the purpose of clarity, detailed descriptions of well-known devices, circuits, tools, techniques, and methods are omitted so as not to obscure the description of the present system. It should be expressly understood that the drawings are included for illustrative purposes and do not represent the scope of the present apparatus. In the accompanying drawings, like reference numbers in different drawings may designate similar elements.

Figure 1:
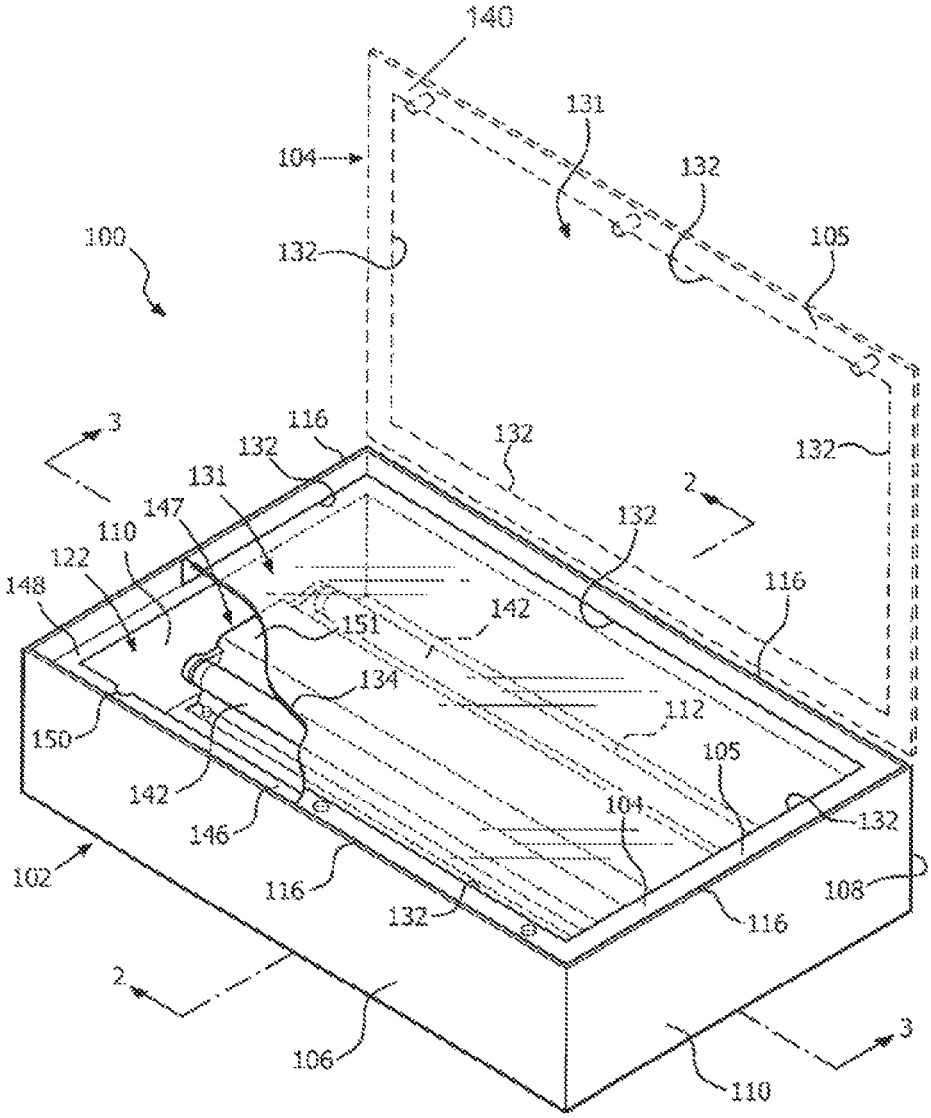
FIG. 1 is a partially cutaway bottom perspective view of a lighting fixture in accordance with embodiments of the present apparatus.
Figure 2:
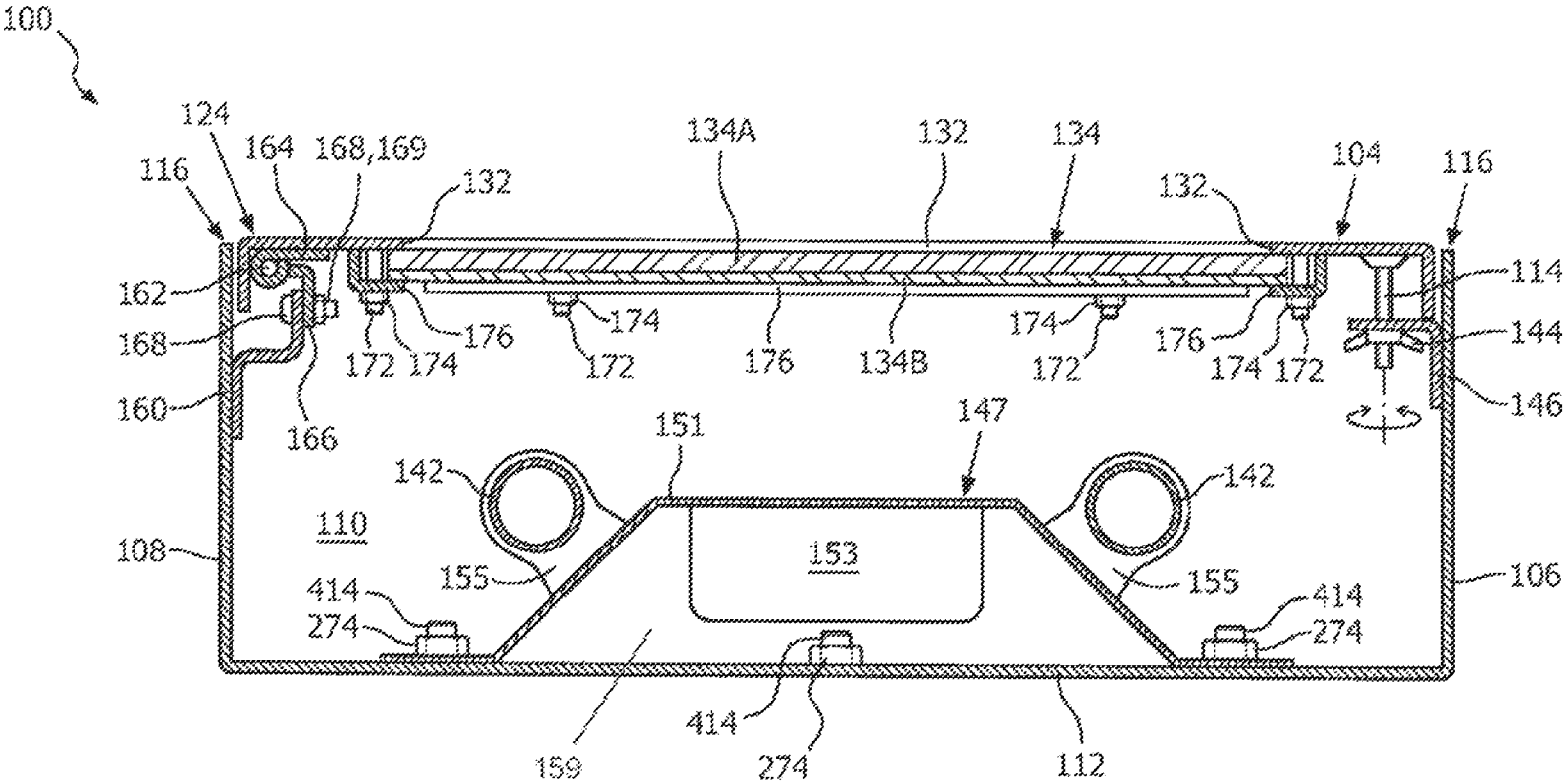
FIG. 2 is a cutaway side view of the lighting fixture taken along lines 2-2 of FIG. 1 in accordance with embodiments of the present apparatus.

FIG. 1 is a partially cutaway bottom perspective view of a lighting fixture 100 in accordance with embodiments of the present apparatus; and FIG. 2 is a cutaway side view of the lighting fixture 100 taken along lines 2-2 of FIG. 1 in accordance with embodiments of the present apparatus.

Referring to FIGS. 1 and 2, the lighting fixture 100 may include a base 102 and a cover 104 which are hingedly attached to each other using, for example, a hinge such as a piano hinge 124 which may extend along a longitudinal axis of the lighting fixture 100 between sidewalls 110 of the base 102.

The base 102 may include a bottom wall 112, a front wall 106, a back wall 108, and/or the sidewalls 110 which may extend from the bottom wall 112 and define at least part of a cavity 122 having an opening 131. The opening may be defined by distal portions 116 of the front wall 106, the back wall 108, and/or the sidewalls 110. Side flanges 148 may be attached to corresponding sidewalls 110 using any suitable method (e.g., welding, rivets, etc.) and may be situated along the sidewalls 110 to provide support to the cover 104 and prevent the cover 104 from being displaced inward towards the bottom wall 112 when subject to an external force (e.g., from a punch, etc.). A Z flange 160 may be attached to the back wall 108 using any suitable method (e.g., welding, rivets, etc.) and may have a "Z"-shaped cross section as shown in FIG. 2. Studs 168 may extend from the Z-flange 160 towards the front wall 106.

A lock flange 146 may be attached to the front wall 106 using any suitable method (e.g., welding, rivets, etc.). The lock flange 146 may include notches 150 or openings which may receive locking pins 140 when the cover 104 is in a closed position and may be positioned relative to the front wall 106 such that the cover 104 is situated flush with, or recessed such as slightly recessed, relative to the opening 131 when in the closed position. The flanges 146, 148, and/or 160 may reinforce the front wall 106, sidewalls 110 and back wall 108, respectively. Further, it is envisioned that the front wall 106, sidewalls 110 and/or the back wall 108 may include folds and/or flanges or the like to provide further reinforcement, if desired.

The hinge 124 may include any suitable hinge such as a piano hinge having first and second portions (e.g., leaves) 166 and 164, respectively which may be coupled to each other by a hinge pin 162 which extends along a longitudinal length of the hinge 124 such that the hinge pin 162 extends through intermeshed knuckles of the first and second portions 166 and 164, respectively. The first portion 166 may be coupled to the Z flange 160 using any suitable method such as by the studs 168 which extend through aligned openings in the Z flange 160. Then, a securing member such as nuts 169, or one-way washers or the like may be placed over the studs to clamp the first portion 166 to the Z flange 160.

The second portion 164 of the hinge 124 may be coupled to the cover 104 using any suitable method (e.g., welding, bonding, adhesives, screws, etc.). The second portion 164 may be folded along its longitudinal axis to define an L-shaped bend having a surface which may be aligned with Z flange 160.

Accordingly, the cover 104 and the base 102 may be hingedly coupled to each other and may rotate relative to each other about an axis of rotation which may correspond with a rotational axis of the hinge 124. A side of the cover 104 which is adjacent to the front wall 106 may be secured to the base 102 using a locking mechanism so as to prevent access to the cavity 122. The locking mechanism which may include, for example, the locking pins 140 which may contact corresponding notches 150 of the lock flange 146 when in a locked position. The locking pins 140 may be spaced apart from each other and may include a locking nut 144 which may contact a corresponding notch 150 of the lock flange 146 when in the closed position so as to secure the cover 104 in the closed position. The locking pins 140 may include a security mechanism such as a keyed head pattern which may receive only a correspondingly keyed key which may be operative to securely engage or disengage the locking pins 140 in closed or open positions, respectively. In accordance with embodiments of the present system, other security mechanisms such as latches, bolts, electromagnets, etc., may also be suitably applied.

The cover 104 may include a frame portion 105 having an opening 130 defined by walls 132 and a lens 134 which is attached to the frame portion 105 using any suitable method (e.g., bolts, rivets, adhesives, etc.). The lens 134 may include one or more layers such as a transparent lens (e.g., polycarbonate, etc.), a translucent lens, a filter (e.g. an ultra-violet (UV) filter, a diffuser, etc.), etc., as desired, and may have an outer periphery which is shaped similarly to, but larger than, the opening 130 as defined by the walls 132. For example, in the present embodiment, the lens 134 may include dual superimposed lenses such as a first lens portion 134A of clear polycarbonate and a second lens portion 134B of acrylic. The lens 134 may be secured to the frame 105 with flanges 176 which overlap an outer periphery of the lens 134 and are clamped to the frame 105 by bolts 172 (or studs) and nuts 174. However, other fastening methods such as adhesives, epoxies, etc., are also envisioned.

In accordance with embodiments of the present system, the lighting fixture 100 may include a lighting assembly 147 including an illumination source 142 such as light emitting diodes (LEDs), incandescent bulbs, fluorescent bulbs, etc., which may be located within the cavity 122 and provide illumination. The lighting assembly 147 may include for example, a base 151, a power supply such as a ballast 153, lamp holders 155, and illumination sources 142 such as fluorescent bulbs. The base 151 may include an inverted "V" type base which may act as a reflector to reflect light from the illumination sources 142 in a desired direction. The base 151 may include openings which may receive studs 414 such as screws, PEM studs, lugs, etc., which are secured to the base portion 102 of the lighting fixture 100. Nuts 274 may then be attached to the studs 414 to secure the base 151 to the base portion 102. However, it is also envisioned that the base may be secured using other methods such as welding, clips, rivets, friction fitting, self-tapping screws, etc. The ballast 153 may be located within a cavity 159 formed by the base 151 and secured to the base 151 using any suitable method such as rivets, screws, etc. However it is also envisioned that the ballast 153 may be located in other areas, and/or secured to other portions such as secured to the bottom wall 112. The ballast 153 may be electrically coupled to the fluorescent bulbs via the lamp holders 155 which may be secured to the base 151. The base 151 may include an access door to access the ballast 153. Accordingly, in embodiments of the present apparatus, the illumination source may include a fluorescent source such as fluorescent bulbs which are driven by corresponding driving circuitry. Further, reflectors may be included to reflect light from the illumination source in a desired direction, pattern, etc.

Figure 3:
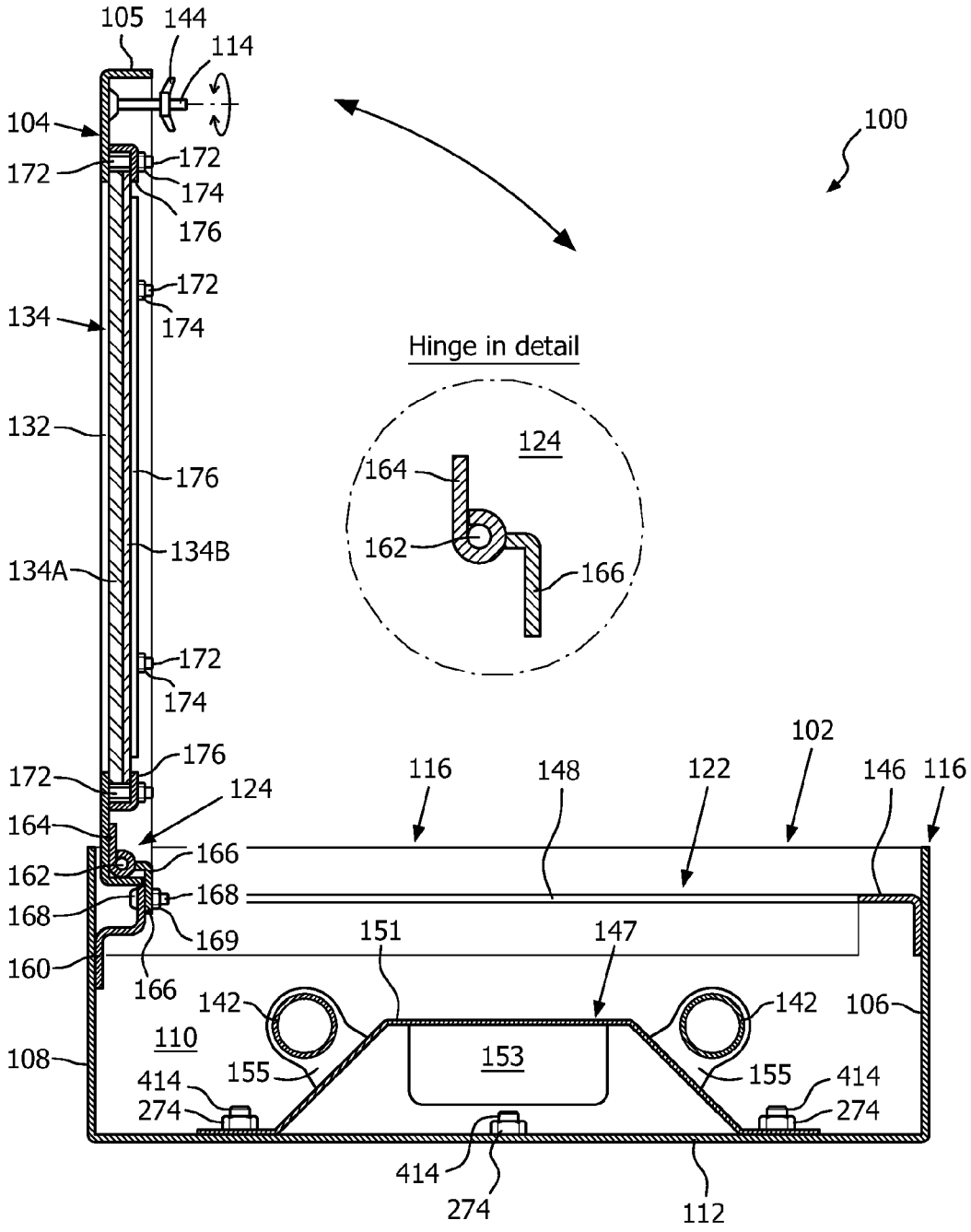
FIG. 3 is a cutaway side view of the lighting fixture shown in FIG. 2 with the cover in an open position in accordance with embodiments of the present apparatus.

FIG. 3 is a cutaway side view of the lighting fixture 100 as shown in FIG. 2 with the cover 104 in an open position. The cover 104 may rotate approximately 90 degrees about an axis of the hinge 124. At an angle slightly beyond 90 degrees, a portion of the cover 104 such as an upper surface of the cover 104 may contact the back wall 108. However, it is also envisioned that stops may be used to limit articulation of the cover 104 relative to the base 102.

Figure 4:
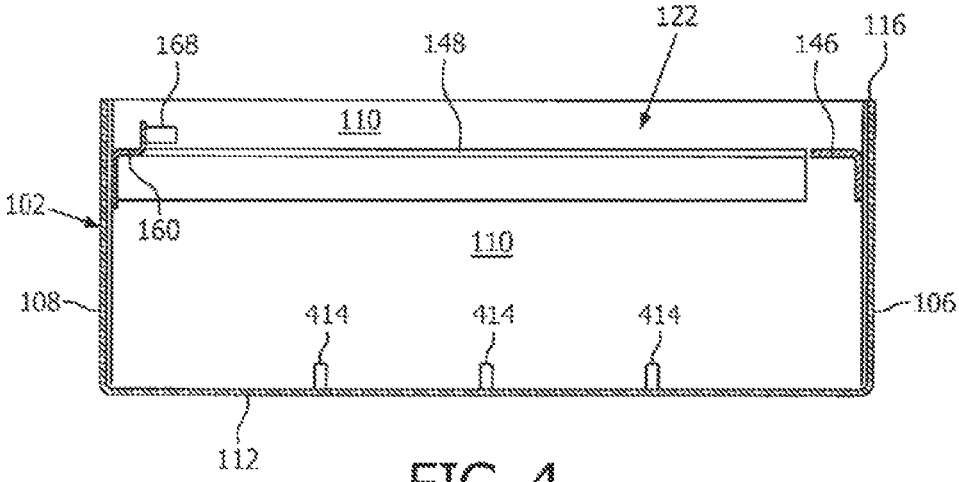
FIG. 4 is cutaway side view of the base of the lighting fixture shown in FIG. 2 in accordance with embodiments of the present apparatus.

FIG. 4 is cutaway side view of a portion of the base 102 of the lighting fixture 100 shown in FIG. 2 in accordance with embodiments of the present apparatus. The base 102 is shown without the cover 104 or hinge 124 attached. The studs 168 may protrude towards the front wall 106 of the base 102 and may include screws, nuts, studs (e.g., PEM™ studs), captive screws, etc., which may be attached, such as welded, screwed, etc., to the Z flange 160 and/or inserted through openings of the Z flange 160. However, other attachment methods are also envisioned such as clips, etc.

Figure 5:
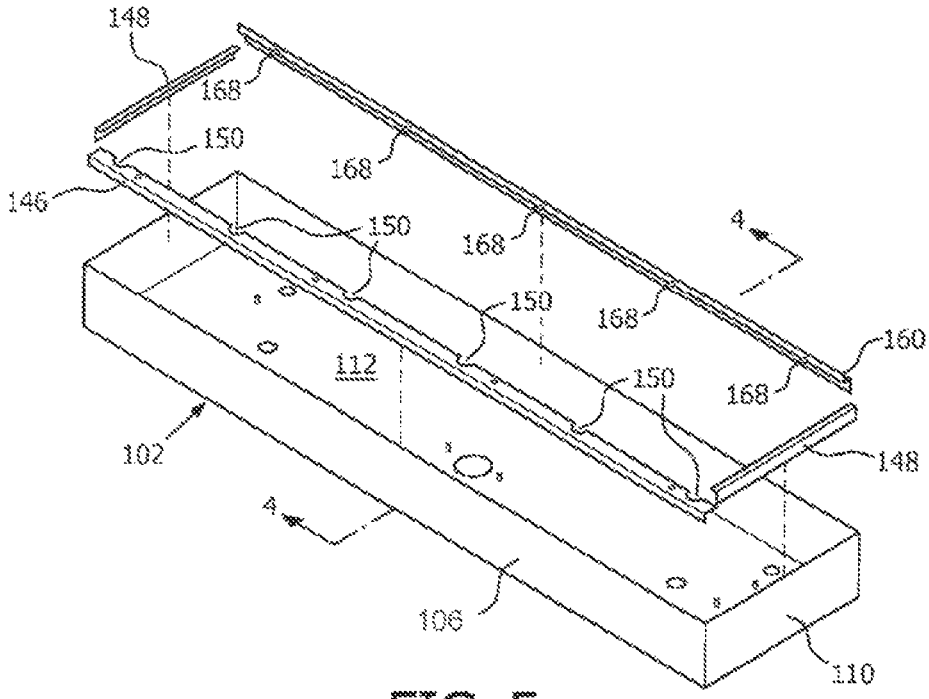
FIG. 5 is an exploded bottom perspective view of a portion of the base of the lighting fixture shown in FIG. 4 in accordance with embodiments of the present apparatus.

FIG. 5 is an exploded bottom perspective view of a portion of the base 102 of the lighting fixture 100 shown in FIG. 4 in accordance with embodiments of the present apparatus. In accordance with embodiments of the present system, the Z flange 160, the side flanges 148, and the lock flange 146 may be attached to adjacent walls using any suitable method such as stitch welding, etc.

Figure 6:
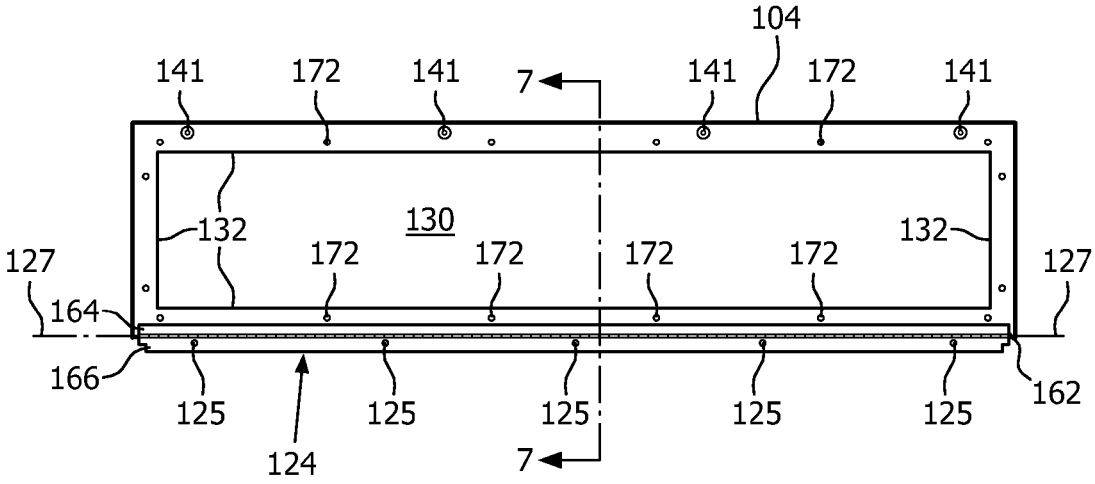
FIG. 6 is a partially cut away plan view of an interior portion of the cover in accordance with embodiments of the present apparatus.

FIG. 6 is a partially cut away plan view of an interior portion of the cover 104 in accordance with embodiments of the present apparatus. The cover 104 may include a plurality of openings 141 shaped and/or sized to receive corresponding locking pins 140 (e.g., see, FIG. 1). The second portion 164 of the hinge 124 may include a plurality of openings 125 shaped and/or sized to receive corresponding studs 168 (e.g., see, FIG. 5). The first portion 166 of the hinge 124 may be coupled to the frame 105 using, for example, a stitch weld. In accordance with embodiments of the present system, the first portion 166 of the hinge 124 may be coupled to the frame 105 utilizing another coupling method including gluing. The first and second portions 166 and 164, respectively, of the hinge 124 may be secured to each other by the hinge pin 162 (shown in the partially cutaway portion of the hinge) and may rotate about a hinge axis which corresponds with a longitudinal axis 127 of the hinge pin 162. In accordance with embodiments of the present system, the coupling of the present system provides a fixed (e.g., a single fixed axis) axis of rotation (e.g., the longitudinal axis 127 of the hinge pin 162) that simplifies opening and closing of the cover relative to the base.

Figure 7:
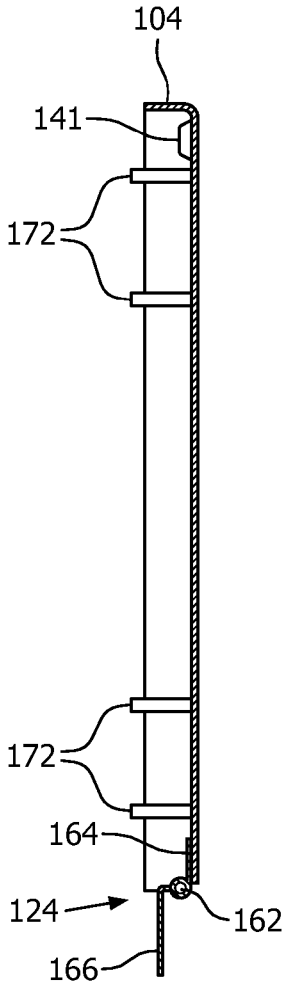
FIG. 7 is a cutaway side view of a portion of the cover taken along lines 7-7 of FIG. 6 in accordance with embodiments of the present apparatus.
Figure 7:
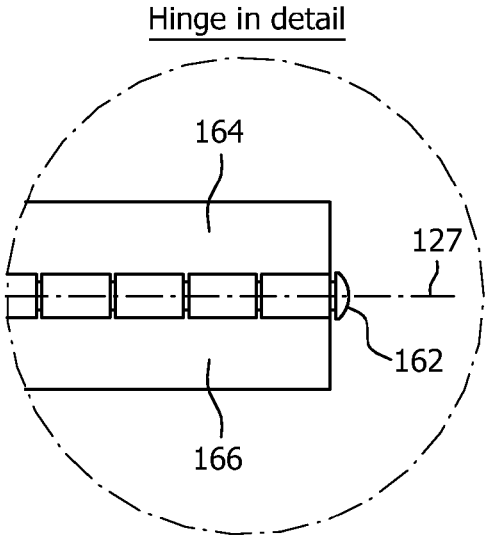

FIG. 7 is a cutaway side view of a portion of the cover 104 taken along lines 7-7 of FIG. 6. Bolts 172 may be attached to the frame 105 of the cover 104 using any suitable method such as welding, etc.

Figure 8:
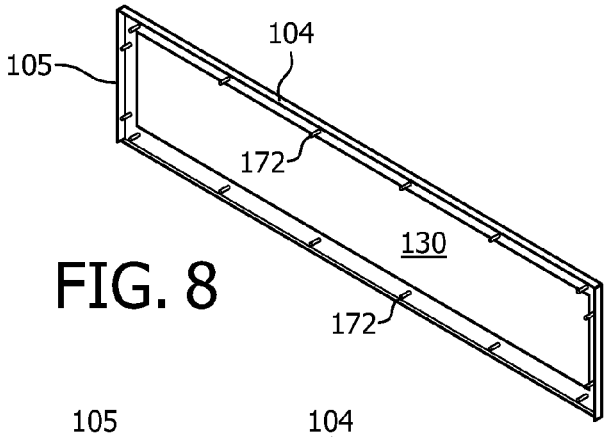
FIG. 8 is a perspective view of the interior portion of the cover in accordance with embodiments of the present apparatus prior to attachment of the lens and the hinge.

FIG. 8 is a perspective view of the interior portion of the cover 104 in accordance with embodiments of the present apparatus prior to attachment of the lens 134 and the hinge 124.

Figure 9:
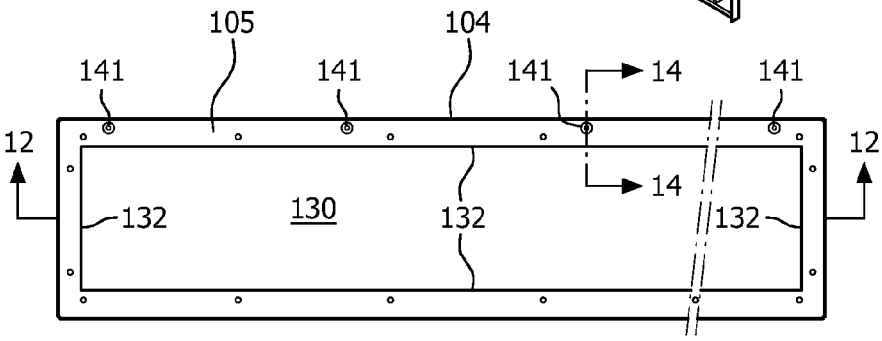
FIG. 9 is a plan view of the interior portion of the cover shown in FIG. 8 in accordance with embodiments of the present apparatus.

FIG. 9 is a plan view of the interior portion of the cover 104 shown in FIG. 8 in accordance with embodiments of the present apparatus.

Figure 10:
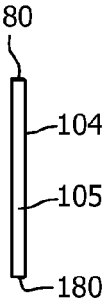
FIG. 10 is a side view of the cover shown in FIG. 9 in accordance with embodiments of the present apparatus.

FIG. 10 is a side view of the cover 104 shown in FIG. 9 in accordance with embodiments of the present apparatus showing the frame 105 and ends 180.

Figure 11:
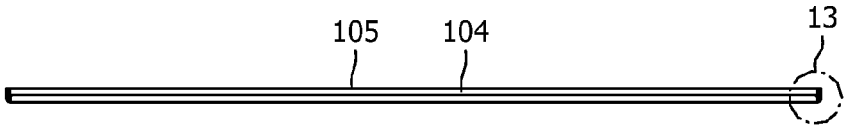
FIG. 11 is a front view of the cover shown in FIG. 9 in accordance with embodiments of the present apparatus.

FIG. 11 is a front view of the cover 104 shown in FIG. 9 in accordance with embodiments of the present apparatus.

Figure 12:
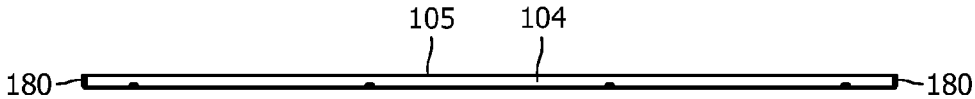
FIG. 12 is a cutaway view of the cover taken along lines 12-12 of FIG. 9 in accordance with embodiments of the present apparatus.

FIG. 12 is a cutaway view of the cover 104 taken along lines 12-12 of FIG. 9 in accordance with embodiments of the present apparatus.

Figure 13:
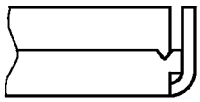
FIG. 13 is a detailed cutaway view of section 13 of FIG. 11 in accordance with embodiments of the present apparatus.

FIG. 13 is a detailed cutaway view of section 13 of FIG. 11 in accordance with embodiments of the present apparatus.

Figure 14:
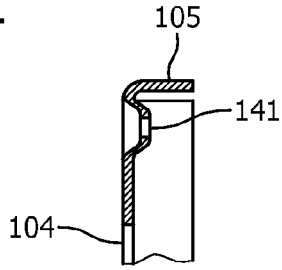
FIG. 14 is a cutaway view of the cover taken along lines 14-14 of FIG. 9 in accordance with embodiments of the present apparatus.

FIG. 14 is a cutaway view of the cover 104 taken along lines 14-14 of FIG. 9 in accordance with an embodiment of the present apparatus. The openings 141 may lie in a recessed portion of the frame 105 of the cover 104. Accordingly, heads of locking pins 140 inserted through the openings 141 may remain substantially flush with, or below, an exterior surface of the frame 105 for added security against tampering.

Figure 15:
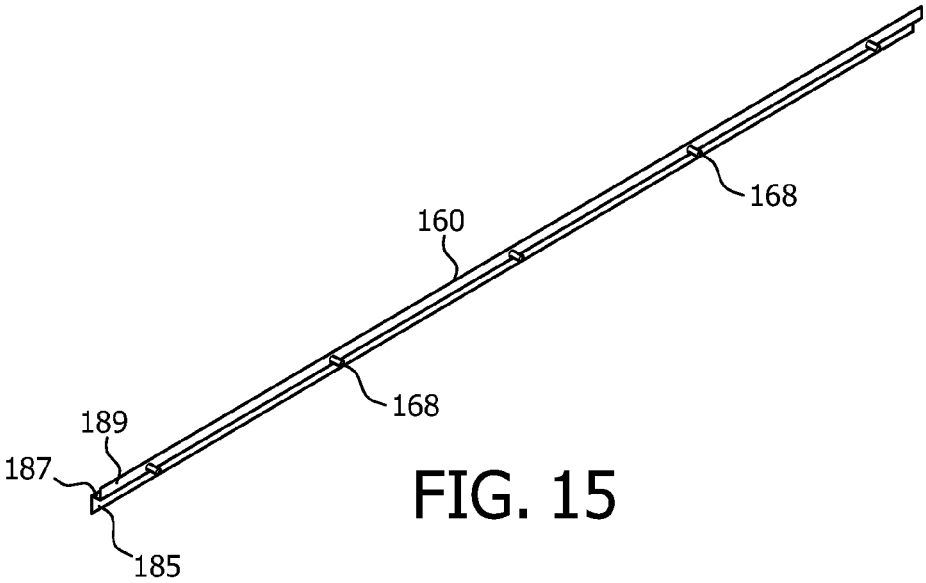
FIG. 15 is a perspective view of the Z flange in accordance with embodiments of the present apparatus.

FIG. 15 is a perspective view of the Z flange 160 in accordance with embodiments of the present apparatus. The studs 168 may be welded to a base portion 161 of the Z flange 160.

Figure 16:
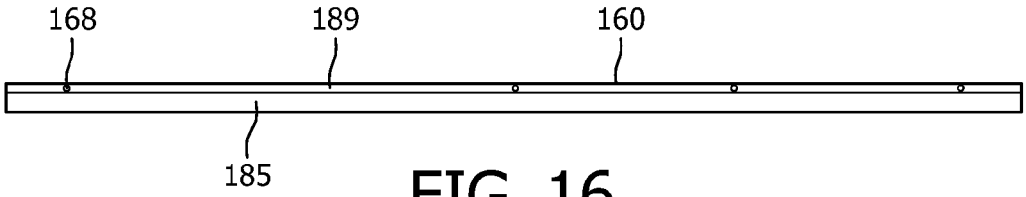
FIG. 16 is a front view of the Z flange of FIG. 15 in accordance with embodiments of the present apparatus.

FIG. 16 is a front view of the Z flange 160 of FIG. 15 in accordance with embodiments of the present apparatus.

Figure 17:
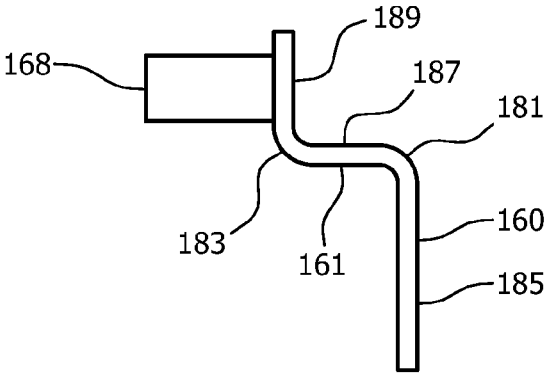
FIG. 17 is a side view of the Z flange of FIG. 15 in accordance with embodiments of the present apparatus.

FIG. 17 is a side view of the Z flange 160 of FIG. 15 in accordance with embodiments of the present apparatus. The base portion 161 may include first through third sections 185, 187, and 189, respectively, which are separated from each other by folds 181 and 183. Folds 181 and 183 are formed in opposite directions and should be separated from each other so that the third section 189 and the lugs 168 are sufficiently spaced away from the back wall 108 when the Z flange 160 is attached to the back wall 108 of the base 102.

Figure 18:
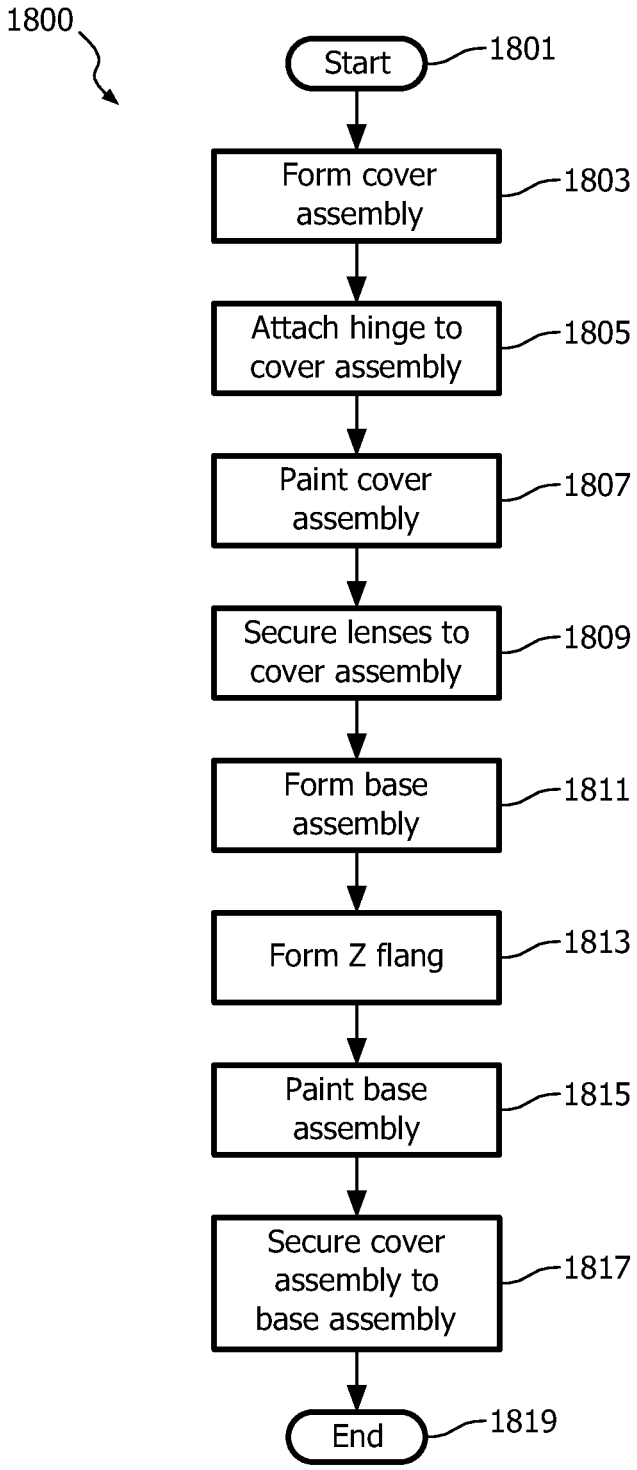
FIG. 18 shows a flow diagram that illustrates a process in accordance with embodiments of the present apparatus.

FIG. 18 shows a flow diagram that illustrates a process 1800 in accordance with embodiments of the present system. The process 1800 may be performed using one or more computers communicating over a network and controlling one or more assembly portions which may perform assembly acts in accordance with embodiments of the present apparatus. The process 1800 may include one of more of the following acts. Further, one or more of these acts may be combined and/or separated into sub-acts, if desired. In operation, the process may start during act 1801 and then proceed to act 1803.

During act 1803, the process may form a cover assembly (e.g., an access door assembly) having a frame with flanged sides and an opening suitable for passing light rays from an illumination source. After completing act 1803, the process may continue to act 1805. During act 1805, the process may attach a piano hinge to the cover assembly. Accordingly, the process may align the piano hinge such that knuckles of the piano hinge are adjacent to a flange of the frame at an interior portion of the frame. The process may then weld a first portion (e.g., a first leaf) of the piano hinge to the frame. It is also envisioned that the piano hinge may include a plurality of serially arranged piano hinges having pins which are aligned with each other. After completing act 1805, the process may continue to act 1807.

During act 1807, the process may paint the door and hinge assembly and continue to act 1809. During act 1809, the process may secure one or more lenses to the cover. The lenses may be secured using any suitable method such as an L bracket secured with studs and nuts. Then, the process may continue to act 1811. During act 1811, the process may form a base assembly having front, back and/or sidewalls which extend from a bottom wall and which form at least part of a cavity for holding an illumination source. Adjacent portions of the walls may be welded to each other so as to form a seam. After completing act 1809, the process may continue to act 1813.

During act 1813, the process may form a Z flange having welded screws or studs (e.g., PEM™ studs, etc.) and weld the Z flange to an interior portion of one of the walls such as a back wall of the base. Then, the process may continue to act 1815. During act 1815, the process may paint the base assembly and continue to act 1817. During act 1817, the process may secure the cover assembly to the base assembly. Accordingly, the process may position the second portion (leaf) of the hinge such that the screws or studs of the Z flange which are positioned to pass through openings in the second portion of the hinge. Then, the process may secure the second portion of the hinge to the Z flange by, for example, using fasteners such as nuts which are threadably secured to the screws or studs of the Z flange. The nuts may include thread-locking tamper-resistant nuts, etc. However, other fasteners are also envisioned such as break-away nuts which make nut removal difficult if not impossible. Then, the process may continue to act 1819 where it ends.

Accordingly, the present system provides a system in which two lighting fixture assemblies such as a base and a cover may be assembled separately and then assembled together after painting. Further, as the hinge is not in view during typical use of the fixture, finishing processes of the hinge such as painting may be simplified which can reduce manufacturing time and/or cost.

Figure 19:
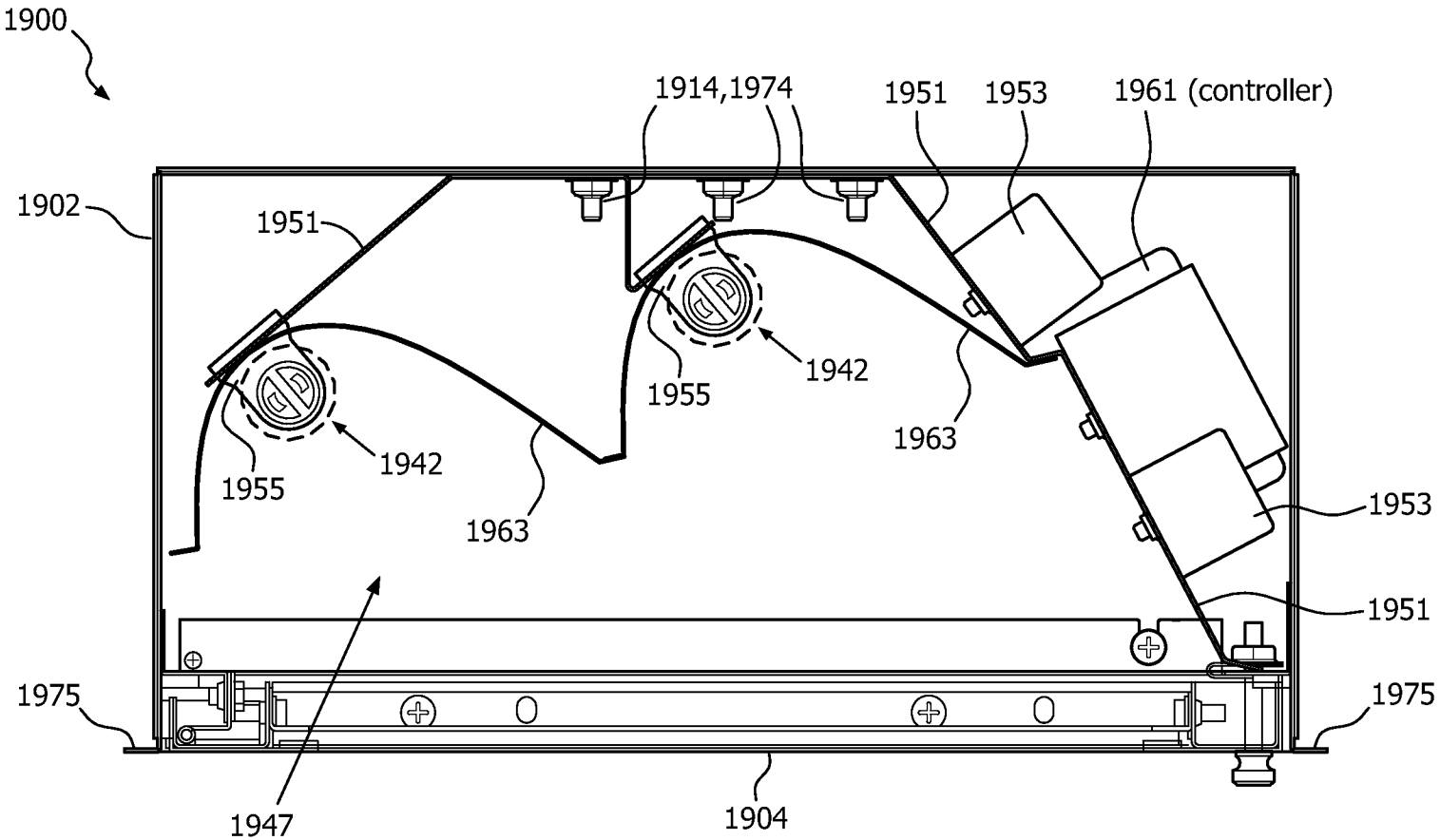
FIG. 19 is a cutaway side view of the lighting fixture in accordance with embodiments of the present apparatus.

FIG. 19 is a cutaway side view of a lighting fixture 1900 in accordance with embodiments of the present apparatus. The lighting fixture 1900 is similar in many respects to the lighting fixture 100 as shown in FIGS. 1 and 2. However, the lighting fixture 1900 includes a lighting assembly 1947 having a reflector 1963 for reflecting light from one or more illumination sources 1942, such as fluorescent bulbs which may be mounted within lamp holders 1955 in a desired orientation (e.g., so that light may be suitably directed by the reflector 1963). The reflector 1963 may be attached to a base 1951 shaped to reflect light from one or more illumination sources 1942. The one or more illumination sources 1942 may be electronically coupled to one or more ballasts such as ballasts 1953 which may be controlled (e.g., energized for providing illumination) by a controller 1961. In accordance with embodiments of the present apparatus, the reflector 1963 may extend along the longitudinal length of the fluorescent bulbs. The base 1951 may be secured to a base portion 1902 using any suitable method such as studs 1914 and nuts 1974. Further, the base portion 1902 may include flanges 1975 at its end walls and may include a cover 1904 hingedly attached to the base 1902 as discussed herein regarding embodiments of the base and cover.

Figure 20:
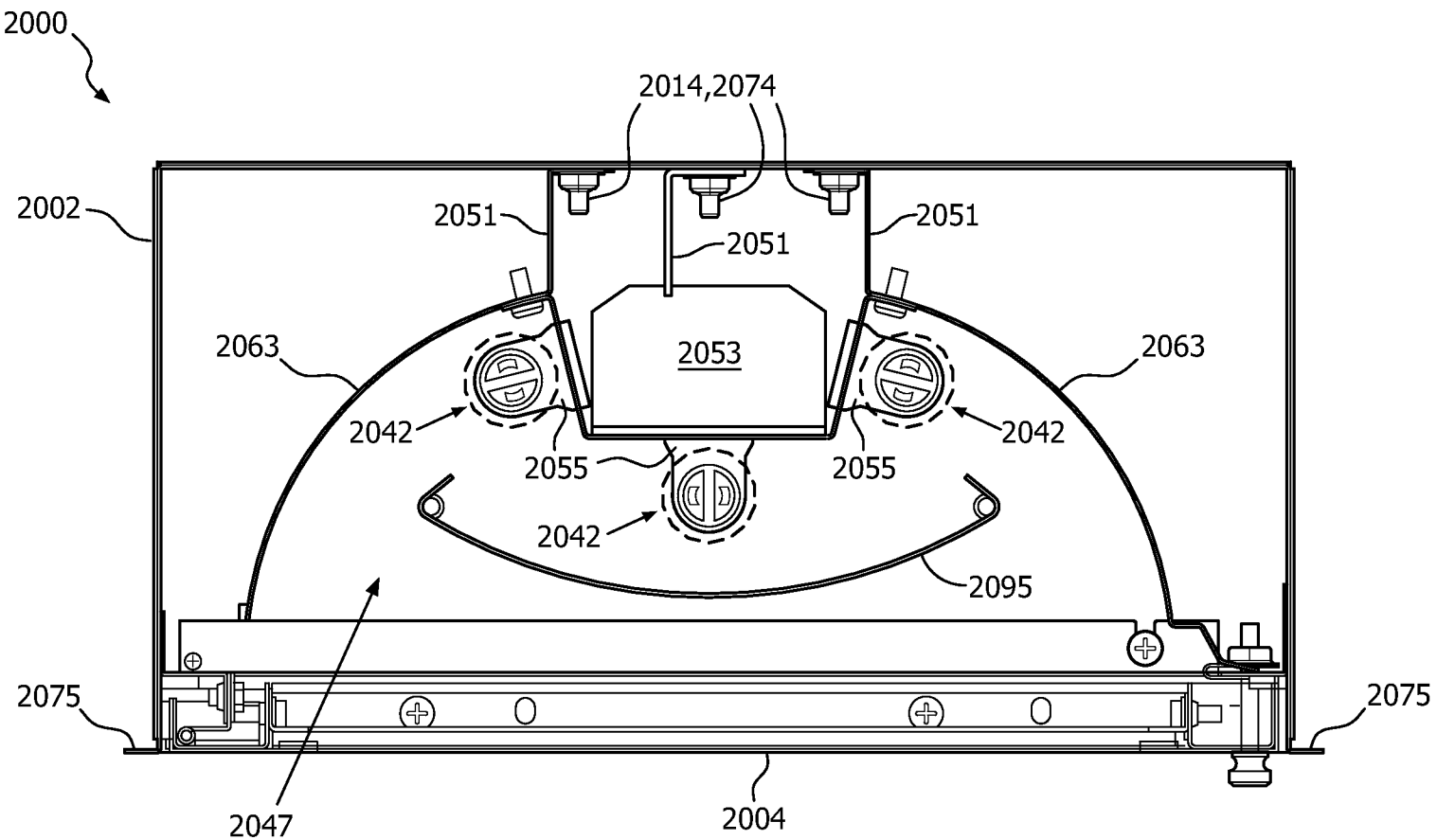
FIG. 20 is a cutaway side view of the lighting fixture in accordance with embodiments of the present apparatus.

FIG. 20 is a cutaway side view of a lighting fixture 2000 in accordance with embodiments of the present apparatus. The lighting fixture 1900 is similar in many respects to the lighting fixture 1900 as shown in FIG. 19. As shown, the lighting fixture 2000 includes a shield 2095, such as a perforated shield 2095, and a lighting assembly 2047 having a reflector 2063 for reflecting light from one or more illumination sources 2042, such as fluorescent bulbs which may be mounted within lamp holders 2055 in a desired orientation. In accordance with embodiments of the present apparatus, the perforated shield 2095 may provide a diffused light from the one or more illumination sources 2042. The reflector 2063 may be attached to a base 2051 and may be shaped to reflect light from the one or more illumination sources 2042. The one or more illumination sources 2042 may be electronically coupled to one or more ballasts such as ballasts 2053 which may include a controller for lighting control. Accordingly, the reflector 2063 may extend along the longitudinal length of the one or more illumination sources 2042. The base 2051 may be secured to a base portion 2002 using any it able method such as studs 2014 and nuts 2074. Further, the base portion 2002 may include flanges 2075 at its end walls and may include a cover 2004 hingedly attached to the base 2002 as discussed herein regarding embodiments of the base and cover.

Further variations of the present system would readily occur to a person of ordinary skill in the art and are encompassed by the following claims.

Finally, the above-discussion is intended to be merely illustrative of the present system and should not be construed as limiting the appended claims to any particular embodiment or group of embodiments. Thus, while the present system has been described with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise;

h) no specific sequence of acts or steps is intended to be required unless specifically indicated; and i) the term "plurality of" an element includes two or more of the claimed element, and does not imply any particular range of number of elements; that is, a plurality of elements may be as few as two elements, and may include an immeasurable number of elements.

What is claimed is:

1. A housing for a light source, the housing comprising:

a base having a plurality of sidewalls which define an opening of a cavity for containing the light source;

a flange having two parallel sections connected by an intermediate section, a first section of the two parallel sections being attached within the cavity to a sidewall of the sidewalls;

a hinge having first and second portions which are rotatably coupled to each other, the first portion being attached a second section of the tow parallel sections of the flange; and a cover having a frame and a lens portion attached to the frame, the frame having an opening and being attached to the second portion of the hinge such that the cover and the base rotate relative to each other about a fixed axis of rotation.

2. The housing of claim 1, further comprising a lighting assembly wherein the base further comprises a bottom part from which the sidewalls extend, the bottom part comprising a mounting portion and defining a portion of the cavity, the mounting portion securing the lighting assembly.

3. The housing of claim 1, wherein the first and second portions of the hinge are rotatably secured to each other with a pin located within the cavity and which extends between opposing sidewalls of the sidewalls.

4. The housing of claim 3, wherein hinge is a piano-type hinge with a plurality of knuckles through which the pin extends.

5. The housing of claim 1, wherein the first portion of the hinge has a fold which extends along a longitudinal length of the hinge.

6. The housing of claim 1, wherein the flange further comprises a plurality of studs which extend towards a sidewall of the sidewalls which is opposite the sidewall to which the flange is attached.

7. The housing of claim 6, wherein the first portion of the hinge has a plurality of openings each configured to receive a corresponding stud of the plurality of studs.

8. The housing of claim 1, wherein the second portion of the hinge is parallel to the two parallel sections of the flange when the cover is in an open position, and the second portion of the hinge is parallel to the intermediate section of the flange when the cover is in a closed position.

9. A method for forming a housing for a light source, the method comprising acts of:

forming a base having a plurality of sidewalls which define an opening of a cavity for containing the light source;

attaching a flange having two parallel sections connected by an intermediate section, a first section of the two parallel sections being to a sidewall of the sidewalls such that the flange is located within the cavity;

attaching a first portion of a hinge to a second section of the two parallel sections of the flange, the hinge having a second portion rotatably coupled to the first portion;

attaching a cover having a frame with an opening to the second portion of the hinge such that the cover and the base rotate relative to each other about a fixed axis of rotation; and attaching a lens to the cover such that light from the light source located within the cavity may pass through the lens.

10. The method of claim 9, further comprising acts of:

forming a bottom part such that the sidewalls extend from the bottom part; and attaching a lighting assembly to the bottom part.

11. The method of claim 9, further comprising an act of rotatably securing the first and second portions of the hinge to each other with a hinge pin which is located within the cavity and which extends between opposing sidewalls of the plurality of sidewalls of the base portion.

12. The method of claim 9, further comprising an act of folding the first portion of the hinge along a longitudinal length of the hinge.

13. The method of claim 9, further comprising an act of forming a plurality of openings in the first portion of the hinge.

14. The method of claim 13, further comprising an act securing a plurality of studs to the flange such that the plurality of studs extend towards a sidewall of the sidewalls of the base which is opposite the sidewall to which the flange is attached.

15. The method of claim 14, wherein the act of attaching a first portion of the hinge to the flange further comprises passing the plurality of studs through corresponding openings of the plurality of openings of the first portion of the hinge.

16. The method of claim 9, wherein the second portion of the hinge is parallel to the two parallel sections of the flange when the cover is in an open position, and the second portion of the hinge is parallel to the intermediate section of the flange when the cover is in a closed position.

* * * * *